US009765443B2

(12) United States Patent
Wilson et al.

(10) Patent No.: US 9,765,443 B2
(45) Date of Patent: Sep. 19, 2017

(54) ELECTROPLATING PROCESSOR WITH CURRENT THIEF ELECTRODE

(71) Applicant: APPLIED Materials, Inc., Santa Clara, CA (US)

(72) Inventors: Gregory J. Wilson, Kalispell, MT (US); Paul R. McHugh, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 76 days.

(21) Appl. No.: 14/843,803

(22) Filed: Sep. 2, 2015

(65) Prior Publication Data

US 2017/0058424 A1 Mar. 2, 2017

(51) Int. Cl.

| | |
|---|---|
| ***C25D 17/00*** | (2006.01) |
| ***C25D 17/12*** | (2006.01) |
| *C25D 7/12* | (2006.01) |

(52) U.S. Cl.

CPC ..... *C25D 17/12* (2013.01); *C25D 17/001* (2013.01); *C25D 17/002* (2013.01); *C25D 17/007* (2013.01)

(58) Field of Classification Search

None

See application file for complete search history.

(56) References Cited

U.S. PATENT DOCUMENTS

| | | | |
|---|---|---|---|
| 6,228,231 B1 | 5/2001 | Uzoh | |
| 8,475,644 B2 | 7/2013 | Mayer et al. | |
| 9,099,297 B2 | 8/2015 | Wilson et al. | |
| 2004/0134775 A1* | 7/2004 | Yang | A23D 7/00 204/296 |
| 2005/0145499 A1* | 7/2005 | Kovarsky | C25D 5/18 205/103 |
| 2007/0144912 A1* | 6/2007 | Woodruff | C25D 17/001 205/148 |
| 2010/0032303 A1 | 2/2010 | Reid et al. | |

(Continued)

FOREIGN PATENT DOCUMENTS

WO 2006091937 A2 8/2006

OTHER PUBLICATIONS

International Application Division, Korean Intellectual Property Office, "The International Search Report and the Written Opinion of the International Searching Authority" issued in International application No. PCT/US2016/047586 (Nov. 11, 2016).

*Primary Examiner* — Harry D Wilkins, III

(74) *Attorney, Agent, or Firm* — Kenneth H. Ohriner; Perkins Coie LLP

(57) ABSTRACT

An electroplating processor has a head including a wafer holder, with the head movable to position a wafer in the wafer holder into a vessel holding a first electrolyte and having one or more anodes. A thief electrode assembly may be positioned adjacent to a lower end of the vessel, or below the anode. A thief current channel extends from the thief electrode assembly to a virtual thief position adjacent to the wafer holder. A thief electrode in the thief electrode assembly is positioned within a second electrolyte which is separated from the first electrolyte by a membrane. Alternatively, two membranes may be used with an isolation solution between them. The processor avoids plating metal onto the thief electrode, even when processing redistribution layer and wafer level packaging wafers having high amp-minute electroplating characteristics.

17 Claims, 10 Drawing Sheets

(56) References Cited

U.S. PATENT DOCUMENTS

| | | | | |
|---|---|---|---|---|
| 2010/0032310 | A1* | 2/2010 | Reid | C25D 21/12 205/261 |
| 2012/0292179 | A1* | 11/2012 | Wilson | C25D 5/08 204/198 |
| 2012/0292181 | A1* | 11/2012 | McHugh | C25D 17/008 204/260 |
| 2013/0062209 | A1 | 3/2013 | Arvin et al. | |
| 2014/0144781 | A1 | 5/2014 | He | |

* cited by examiner

ELECTROPLATING PROCESSOR WITH CURRENT THIEF ELECTRODE

BACKGROUND OF THE INVENTION

Microelectronic devices, such as semiconductor devices, are generally fabricated on and/or in wafers or workpieces. A typical wafer plating process involves depositing a seed layer onto the surface of the wafer via vapor deposition. The wafer is then moved into an electroplating processor where electric current is conducted through an electrolyte to the wafer, to apply a blanket layer or patterned layer of a metal or other conductive material onto the seed layer. Examples of conductive materials include permalloy, gold, silver, copper, and tin. Subsequent processing steps form components, contacts and/or conductive lines on the wafer.

In some electroplating processors, a current thief electrode, also referred to as an auxiliary cathode, is used to better control the plating thickness at the edge of the wafer and for control of the terminal effect on thin seed layers. The terminal effect for a given seed layer increases as the electrical conductivity of the electrolyte bath increases. Hence, a current thief electrode can be effectively used with thinner seed layers combined with high conductivity electrolyte baths. The use of thin seed layers is increasing common with redistribution layer (RDL) and wafer level packaging (WLP) plated wafers. For example, it is expected that RDL wafers may soon have copper seed layers as thin as 500 A-1000 A and copper bath conductivities of 470 mS/cm or higher.

In WLP processing, a relatively large amount of metal is plated onto each wafer. Consequently, in a WLP electrochemical processor having a current thief electrode, a large amount of metal will also be plated on the current thief electrode. This metal must be deplated or otherwise removed from the current thief electrode at frequent intervals, with the processor removed from use during the deplating operation. Deplating the current thief electrode can also result in contamination particles in the electrolyte bath.

Damascene electroplating processors have used a current thief electrode, in the form of a platinum wire, inside of a membrane tube. The membrane tube holds a separate electrolyte (referred to as thiefolyte) having no metal (e.g., a 3% sulfuric acid and deionized water solution). The thief cathode reaction mostly evolves hydrogen rather than plating copper onto the wire. The hydrogen is swept out of the tube by the flowing thiefolyte. However, some metal does cross the membrane into the thiefolyte and plates onto the platinum wire (especially when using a lower conductivity bath). Consequently, the thiefolyte is only used once and flows to drain after passing through the membrane tube. The platinum wire is deplated after processing each wafer. However, under certain conditions using high thief current, it may be difficult to fully deplate the platinum wire.

The amp-minutes involved in processing RDL and WLP wafers can be 20 to 40 times higher than for damascene. As a result, the wire in a membrane tube thief electrode used in damascene electroplating may not suitable for electroplating RDL and WLP wafers, due to excessive metal plating onto the thief electrode wire, and excessive consumption of thiefolyte. Accordingly, engineering challenges remain in designing apparatus and methods for electroplating RDL and WLP wafers, and other applications, using a thief electrode.

SUMMARY OF THE INVENTION

In a first aspect, an electroplating processor has a vessel holding a first electrolyte or catholyte containing metal ions. A head has a wafer holder, with the head movable to position the wafer holder in the vessel. One or more anodes are in the vessel. A second electrolyte or isolyte in a second compartment is separated from the catholyte by a first membrane. A third electrolyte or thiefolyte in a third compartment is separated from the isolyte by a second membrane. A current thief electrode is in the thiefolyte. The current thief electrode is connected to an auxiliary cathode and provides a current thieving function during electroplating. Build-up of metal on the current thief electrode is reduced or avoided via the membranes preventing metal ions from passing from the catholyte into the thiefolyte.

BRIEF DESCRIPTION OF THE DRAWINGS

In the drawings, the same element number indicates the same element in each of the views.

DETAILED DESCRIPTION OF THE DRAWINGS

Figure 1:
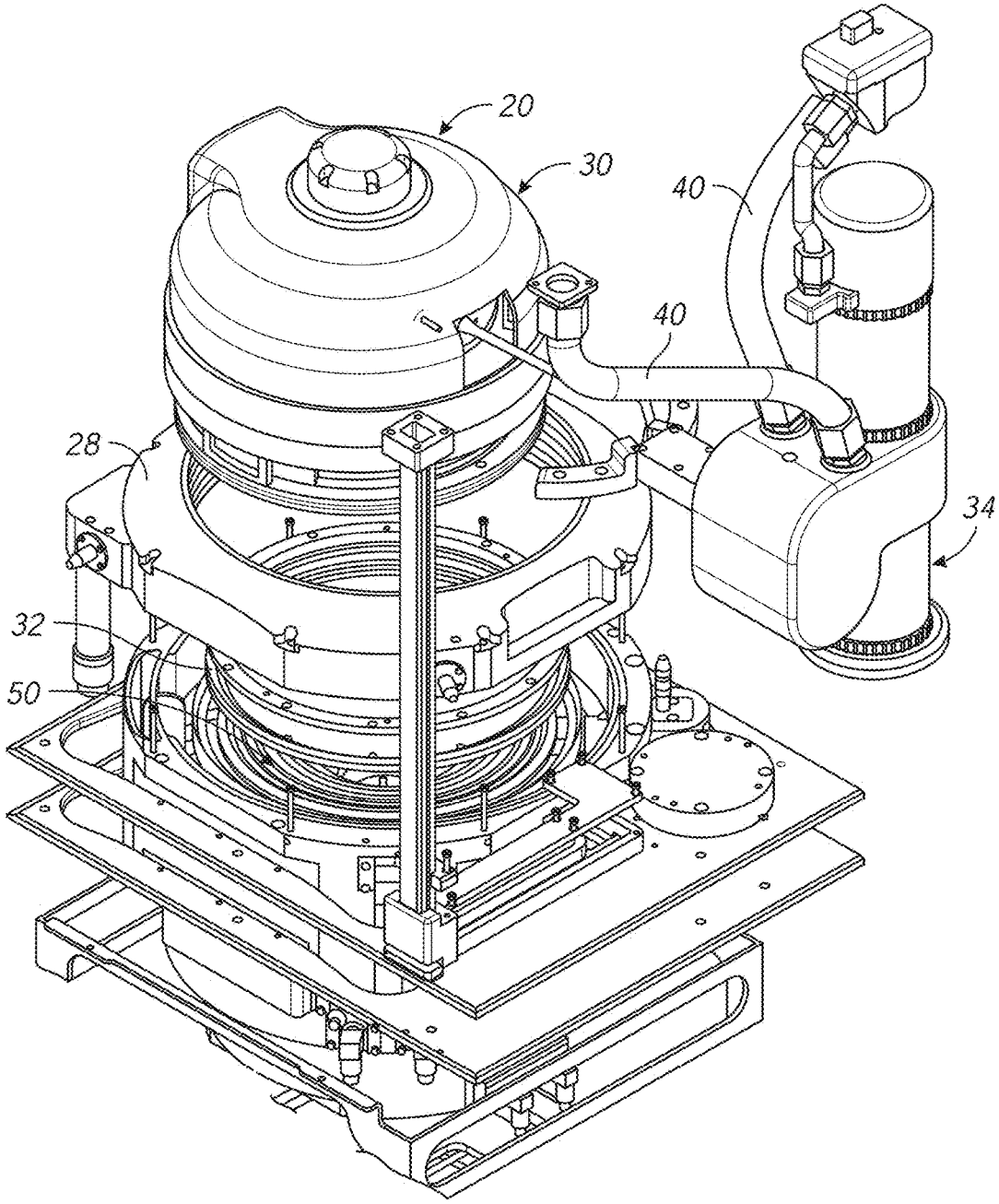
FIG. 1 is an exploded top and front perspective view of an electrochemical processor.
Figure 2:
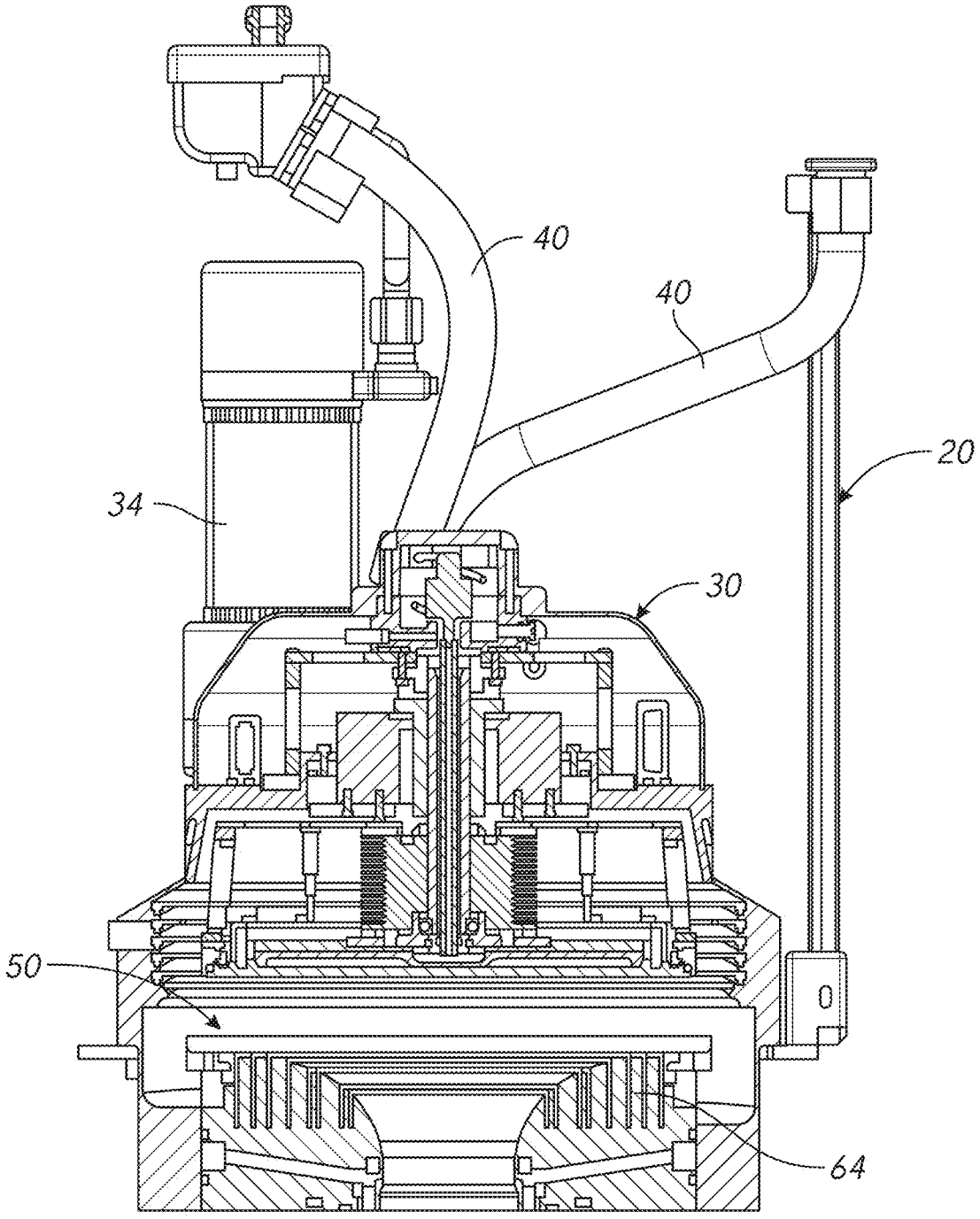
FIG. 2 is a side section view of the processor shown in FIG. 1.

Turning now in detail to the drawings, as shown in FIGS. 1-2, an electrochemical processor 20 has a head 30 positioned above a vessel assembly 50. A single processor 20 may be used as a stand alone unit. Alternatively, multiple processors 20 may be provided in arrays, with workpieces loaded and unloaded in and out of the processors by one or more robots. The head 30 may be supported on a lift or a lift/rotate unit 34, for lifting and/or inverting the head to load and unload a wafer into the head, and for lowering the head 30 into engagement with the vessel assembly 50 for processing. Electrical control and power cables 40 linked to the lift/rotate unit 34 and to internal head components lead up from the processor 20 to facility connections, or to connections within multi-processor automated system. A rinse assembly 28 having tiered drain rings may be provided above the vessel assembly 50.

Figure 3:
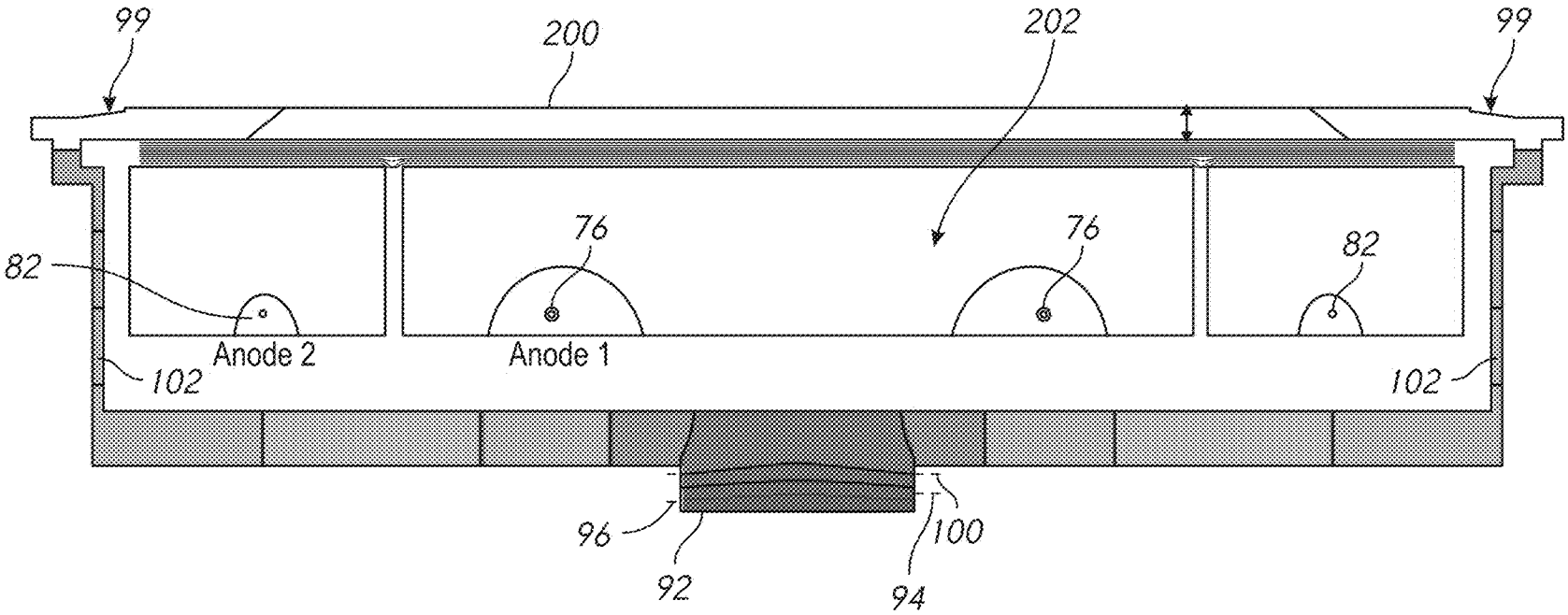
FIG. 3 is a computational model of an electric field within the processor of FIGS. 1-2.

Referring to FIG. 3, a current thief electrode assembly 92 is provided at a central position towards the bottom of the vessel assembly 50. The current thief electrode assembly 92 allows thief current to be distributed uniformly around the edge of the wafer 200 while having a relatively small electrode area. Any membranes used may be small, making sealing around the membranes easier. The current thief electrode has a relatively small diameter (e.g. an effective diameter less than about 140 mm, 120 mm, or 100 mm). However, the current thief electrode assembly functions as a virtual annular thief with a much larger diameter (e.g. larger than wafer diameter). For a processor designed for 300 mm diameter wafers, the virtual annular thief has a diameter greater than 310 mm, for example, 320, 330, 340 or 350 mm. The virtual thief electrode is created by placing the thief source near or at the chamber centerline, so that thief current flows radially outward and up to the level of the wafer.

The current thief electrode assembly 92 may be used in a processor 20 having anodes 76 and 82 in the form of a wire-in-a-tube. A thief electrode wire 94 is provided in the thiefolyte channel 96 in the current thief electrode assembly 92. Virtual thief current channels 102 extend up through the vessel assembly from the current thief electrode assembly 92 to a virtual thief position 99 near the top of the vessel assembly, beyond the edge of the wafer 200.

Figure 4:
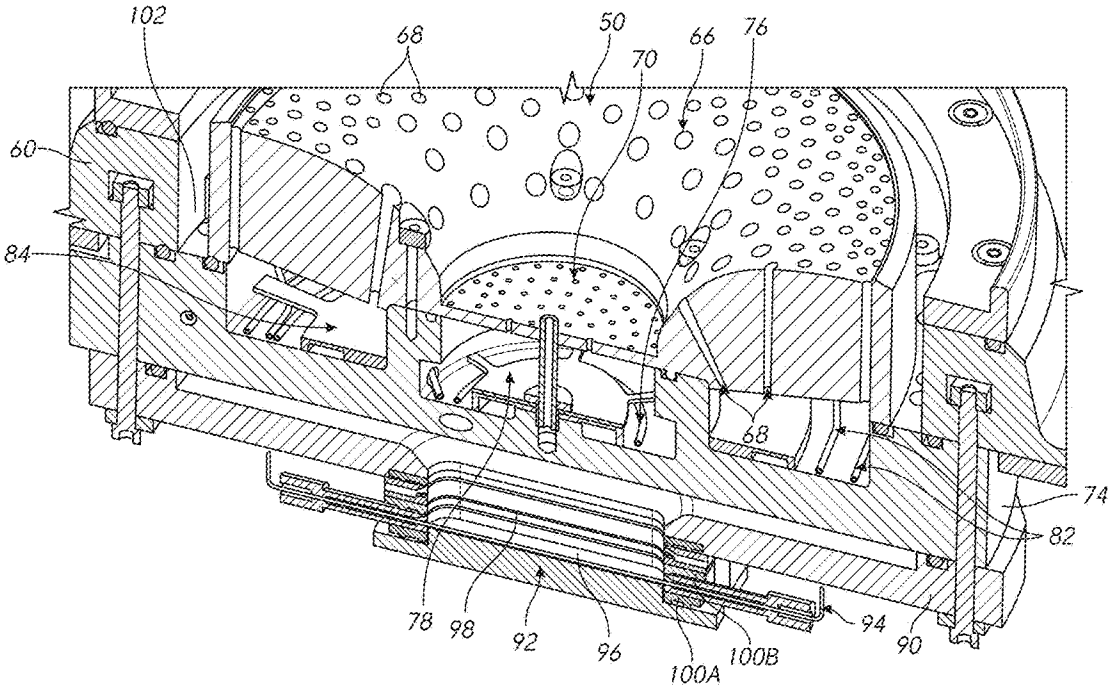
FIG. 4 is a perspective section view of the processor shown in FIGS. 1-3.

FIG. 4 shows an example of a processor designed using the concepts of FIG. 3. In FIG. 4, the processor 20 includes an outer ring 60 around an inner ring or cup 64 within a vessel assembly 50. The inner ring 64 may have a top surface 66 which curves downward from an outer perimeter of the inner ring 64 towards a central opening 70 of the inner ring 64. Holes or passageways 68 extend vertically through the inner ring 64, from anode compartments in an anode plate 74 below the inner ring 64 to a catholyte chamber or space above the inner ring 64. A first anode 76 in an inner anode compartment is provided in the form of a wire in a membrane tube.

Similarly, one or more second anodes 82 in an outer anode compartment are also provided in the form of an inert anode wire in a membrane tube. Flow diffusers 78 and 84 may be used, with the anode tubes on the outlet side of the diffusers. The diffusers may have tabs for holding the membrane tubes down against the floor of the anode compartment. During use, the catholyte chamber holds a liquid electrolyte, referred to as catholyte. Typically, a solution of sulfuric acid and deionized water, referred to as anolyte, circulates through the membrane tubes of the anodes 76 and 82. The circulating anolyte sweeps oxygen evolved off the inert anode wires within the tubes. The anolyte also provides a conductive path for the electric field from the inert anode wire to the catholyte.

Referring still to FIG. 4, the current thief electrode assembly 92 is supported on a thief plate 90 attached to the anode plate 74 and/or the outer ring 60. The current thief electrode assembly 92 includes a thief electrode wire 94 in a thiefolyte channel 96. The thief electrode wire 94 is connected to an auxiliary cathode. The auxiliary cathode is a second cathode channel or connection to the processor which is independent of the first cathode channel connected to the wafer. The thiefolyte channel 96 is separated from the catholyte 202 in the vessel assembly by a membrane. The channels 102 are filled with catholyte and function as virtual thief channels. The thiefolyte channel is separated from an isolyte, i.e., another electrolyte providing an isolation function, by a membrane. The isolyte is then separated from the catholyte by another membrane.

The catholyte 202 in the channels 102 conducts the electric field created by the current thief electrode assembly 92 to the virtual thief position 99. In this way, the current thief electrode assembly 92 simulates having an annular thief electrode near the top of the vessel assembly 50.

Figure 5:
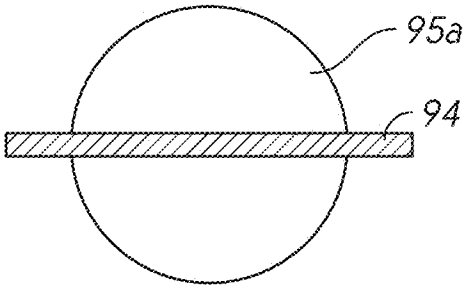
FIGS. 5-7 show examples of thief electrodes.
Figure 6:
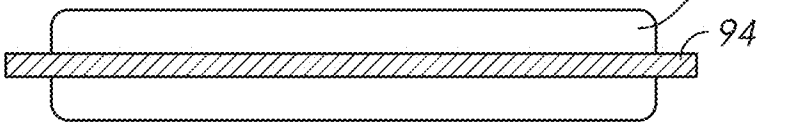
Figure 7:
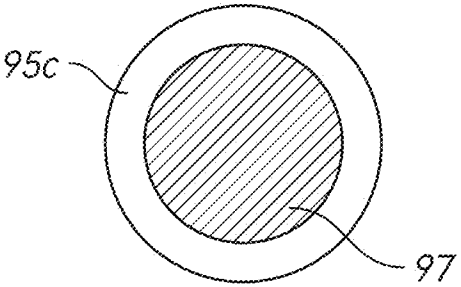

FIG. 5-7 show embodiments of thief electrodes. The electric current flowing through the thief electrode wire 94 is relatively small compared to the wafer current (1-20%) i.e., the current flowing from the anodes 76 and 82 through the catholyte 202 to the wafer 200. Hence, the current thief electrode assembly 92 may use a small electrode and membrane area. Also because the current thief electrode assembly 92 is remote from the wafer 200, the current thief electrode assembly 92 may be provided in varying shapes, other than annular. For example, the current thief electrode assembly 92 may be provided as a platinum wire that is 2.5 to 10 cm long. In comparison, a circumferential wire-in-a-tube thief electrode as used in existing electroplating processors is approximately 100 cm long.

In FIG. 5, the thief electrode wire 94 extends through a flat membrane 95A. In FIG. 6, the thief electrode wire 94 is within a membrane tube 95B. In FIG. 7 the thief electrode wire 94 is replaced by a metal plate or disk 97 is within a membrane cover 95C. In each case the thief electrode wire 94 or thief disk 97 is electrically connected to an auxiliary cathode. Metal mesh may be used in place of the thief electrode wire 94 or the thief disk 97.

Figure 8:
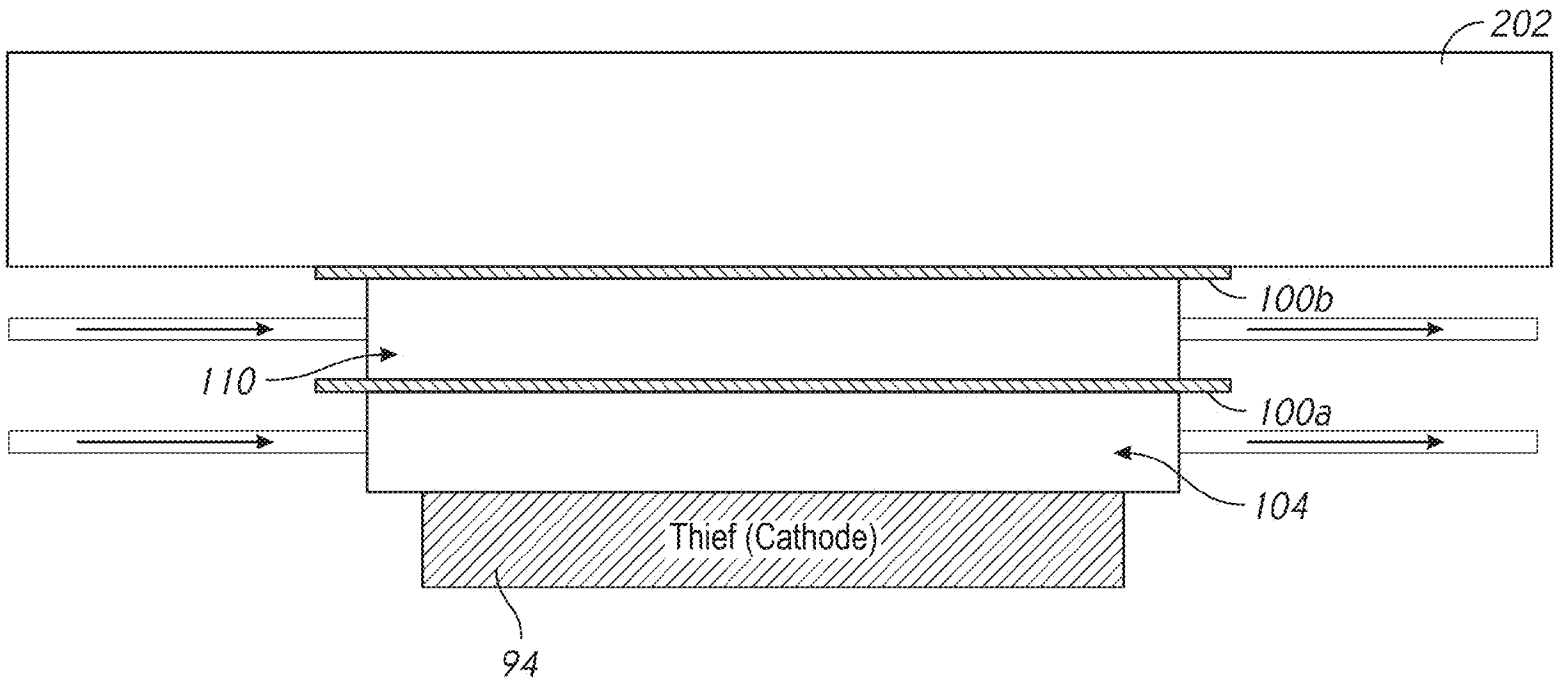
FIG. 8 is a diagram of a thief electrode using two flat membranes.

Turning to FIGS. 4 and 8, another membrane and isolation solution may be added to the current thief electrode assembly 92. In this design, an isolyte compartment 110 containing an isolation solution or isolyte is separated from a thiefolyte compartment containing a thiefolyte by the first membrane 100A, and the isolyte compartment 110 is separated from the catholyte 104 by a second membrane 100B. The isolyte 110 may also be a sulfuric acid and deionized water solution. If the isolyte is used in the processor of FIGS. 3-4 having anodes in the form of a wire-in-a-tube, then the isolyte may be the same liquid as the anolyte flowing through the membrane tubes of the anodes 76 and 84. Therefore, besides the plumbing to the small fluid volume in the current thief electrode assembly 92, using the isolyte does not add significant cost or complexity to the processor.

The isolyte greatly reduces the amount of metal ions that are carried into the thiefolyte. In the case of a processor plating copper, because the isolyte has a low pH and a very low copper concentration (as copper is only carried across the second membrane 100B) even a lower number of copper ions will be transported across the first membrane 100A and into the thiefolyte touching the thief electrode wire 94. Thus, any plating onto the thief electrode wire will be very small. The catholyte solution for WLP has a low pH (high conductivity) and so the copper flow across the membrane separating the catholyte and the isolyte is low. In turn, the isolyte has both a low pH and a low copper concentration. These factors combine to yield an even lower flow of copper across the membrane separating the isolyte and the thiefolyte.

If the isolyte is also the anolyte solution flowing through the membrane tubes of the anodes 76 and 84, some of the copper ions that get into the anolyte/isolation solution will pass through the anode membrane tubes and back into the catholyte 202. Furthermore, by greatly reducing the amount of copper transported into the thiefolyte, the thiefolyte may be recirculated rather than used only once. Recirculating the thiefolyte greatly reduces processing costs compared to using the thiefolyte only once as is done with damascene wafer processors. The small amount of copper that does make it to the thiefolyte may plate onto the thief electrode wire 94, but only in small amounts that can be quickly deplated between wafers.

The fluid compartments illustrated in FIG. 8 can be small so that the fluid turnover is high. In the thiefolyte, this turnover sweeps hydrogen bubbles out of the fluid volume. The isolyte (which may also be the anolyte) and the thiefolyte 104 may be replaced on a bleed and feed schedule. Large quantities may be economically replaced because of the low cost of sulfuric acid and deionized water solutions.

As the volumes of the isolyte and thiefolyte are low, less solution is sent to drain compared to single use thiefolyte.

Figure 9:
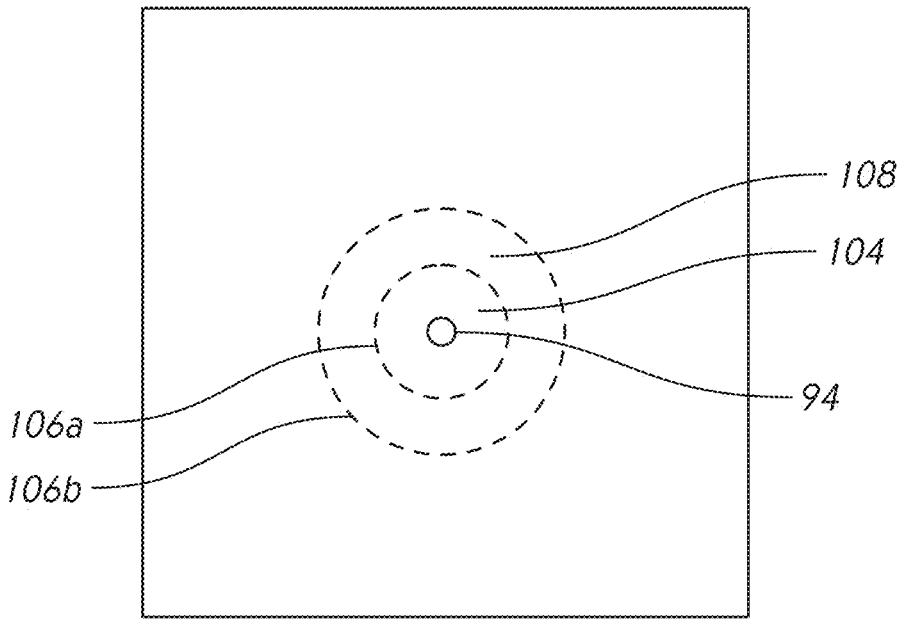
FIG. 9 shows a design similar to FIG. 8 but using tube membranes.

FIG. 9 shows a design similar to FIG. 8, with an inner membrane tube 106A within an outer membrane tube 106B, to form an isolation flow path 108.

Figure 10:
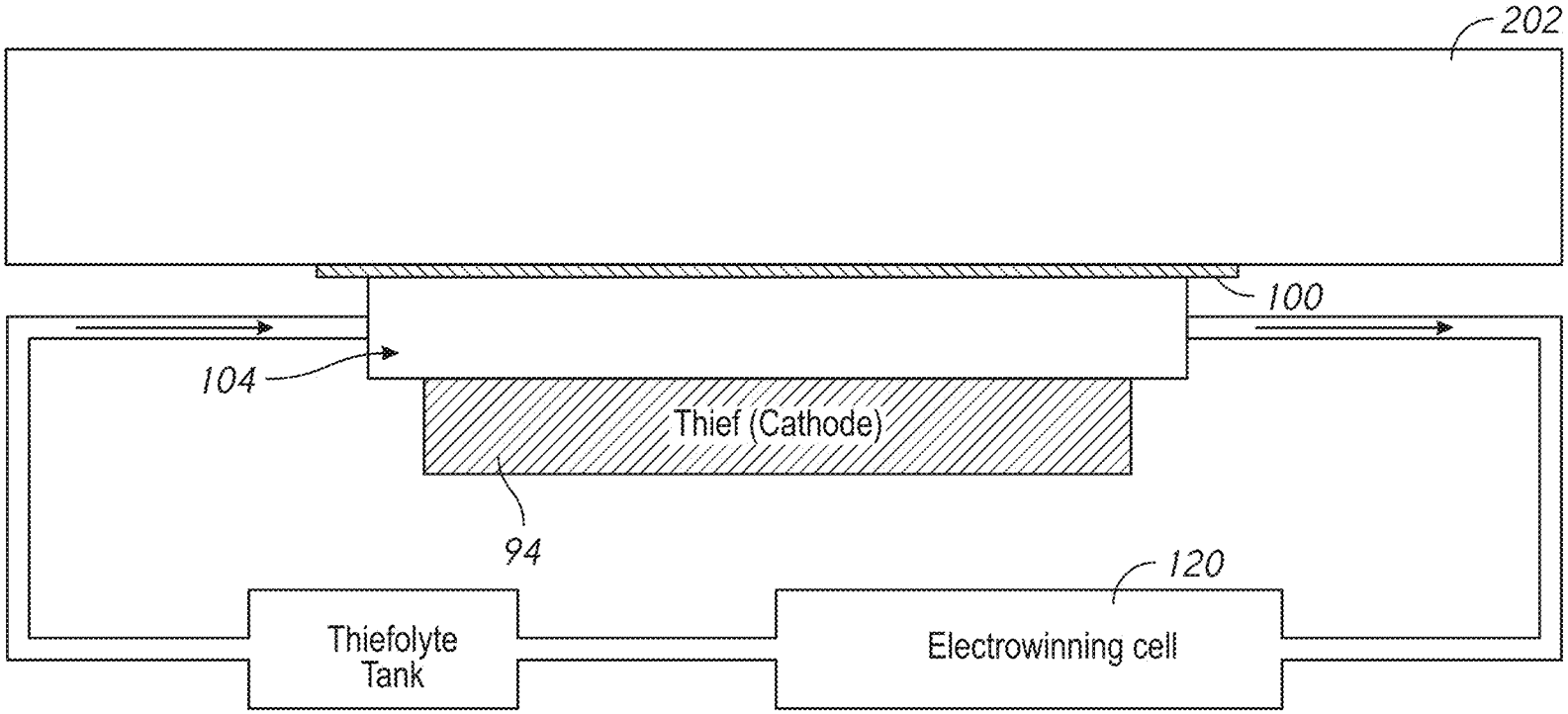
FIG. 10 is a diagram showing use of an electrowinning cell.

As shown in FIG. 10, a single membrane 100 may be used, with the thiefolyte flowing through an electrowinning cell or channel 120 to remove any metal getting into the thiefolyte across the membrane 100. This reduces thief maintenance and also avoids single use thiefolyte. The electrowinning electrode involves maintenance to remove plated on metal build up, but this electrode may be centralized for all the chambers on the thiefolyte fluid loop. This configuration may be used without the electrowinning cell or channel 120, but with the membrane 100 being a monovalent type or anionic type membrane.

Figure 11:
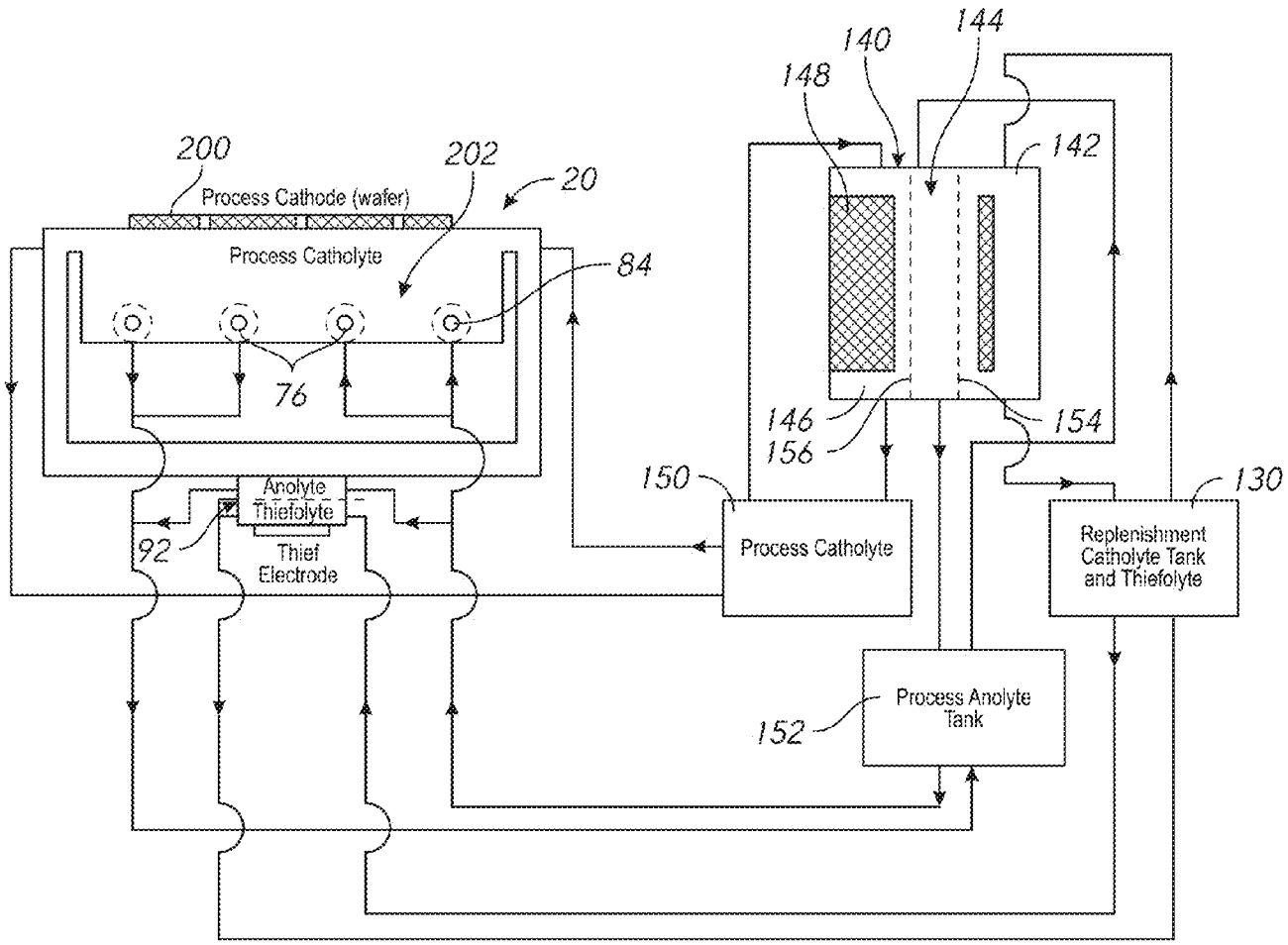
FIG. 11 is a diagram of the processor of FIG. 1 connected to a replenishment cell.

FIG. 11 shows a processor 20 as described above with the thiefolyte channel 96 connected to a first chamber 142 of a replenishment cell 140 via a replenishment catholyte tank 130. The catholyte 202 in the catholyte chamber of the processor 20 flows through a third chamber 146 having a consumable anode 148, such as bulk copper pellets, and optionally through a catholyte rank 150. Anolyte from the anodes 76 and 84 flows through a second central chamber 144 of the replenishment cell 140, and optionally through an anolyte tank 152. The second central chamber 144 is separated from the first and third chambers via first and second membranes 154 and 156.

Figure 12:
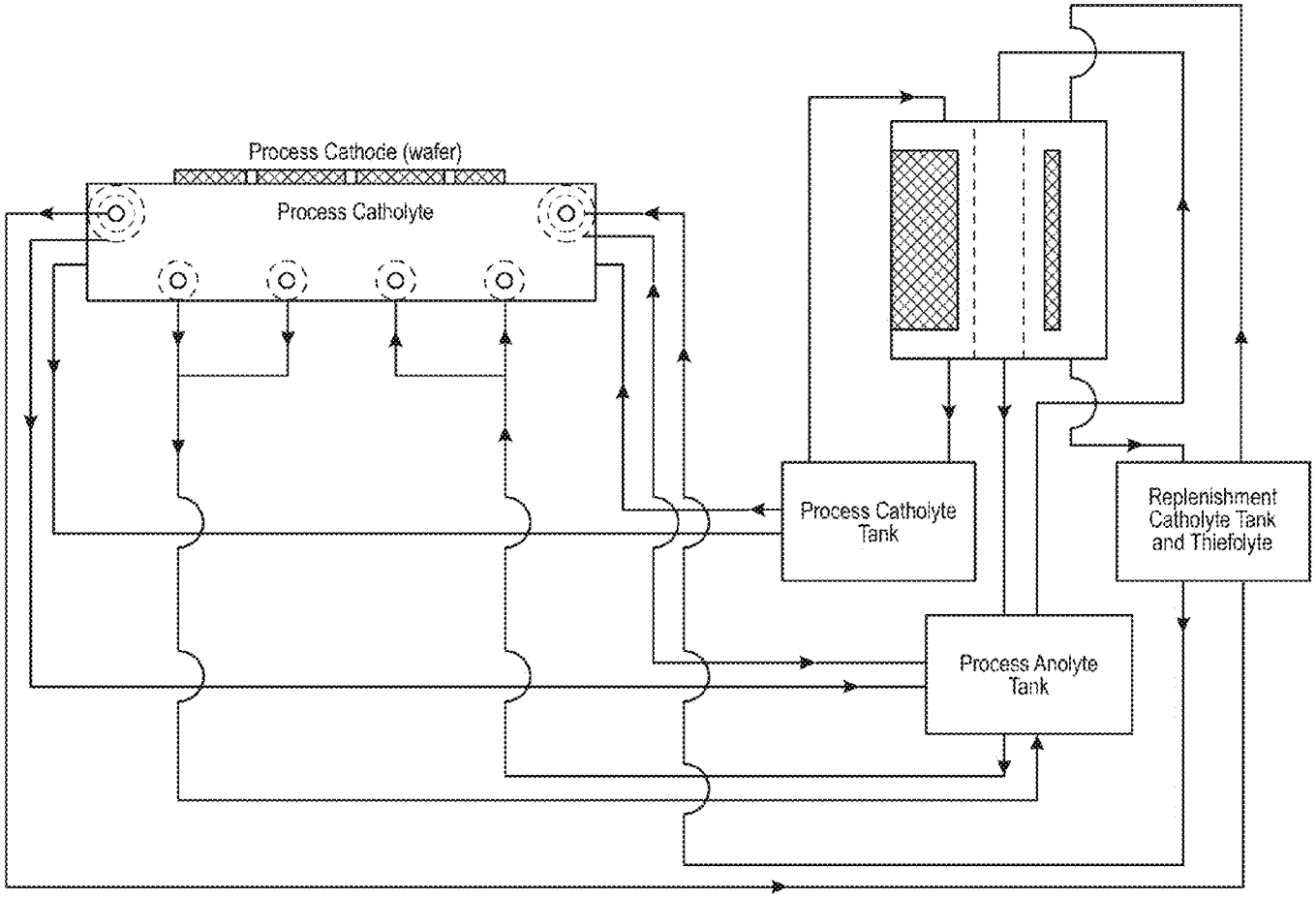
FIG. 12 shows a design similar to FIG. 11 but with the thief electrode at an alternative position.

FIG. 12 shows a design similar to FIG. 11 but using an annular thief electrode wire within a membrane tube, closer to the top of the vessel assembly. This design allows a paddle or agitator to be used in the vessel assembly.

The apparatus and methods described provide a current thieving technique for plating WLP wafers, while overcoming the maintenance issue of copper plate-up on the thief electrode. This may be achieved by a two-membrane stack using cationic membranes and high conductivity (low pH) electrolytes. The copper containing catholyte is separated from a low-copper isolyte by a cationic membrane, which in turn is separated from the lower-copper thiefolyte by another cationic membrane. The thief electrode resides within the thiefolyte. The combination of chemistries and membranes resists migration of copper ions to the thief electrode.

This two-membrane design, with the thief electrode separated from the catholyte in the vessel assembly by two membranes and two electrolytes, is suitable for preventing copper build on the thief electrode during long amp-minute wafer level packaging electroplating. The two separating electrolytes can be the same conductive fluid (i.e. acid and water). The two separating membranes can be cation or monovalent membranes. The separating isolyte and thiefolyte compartments can be formed as a stack with planar membranes, or the two membranes can be formed using co-axial tubular membranes with the inner tube membrane containing the thiefolyte and a wire thief electrode. The thief assembly mid-compartment can be the same electrolyte as the anolyte flowing over inert anodes within the process chamber.

Alternatively, a single membrane may be used to separate the catholyte from the thiefolyte. The catholyte contains copper but has a low pH. The thiefolyte is intended to have no copper. The membrane can be an anionic membrane that prevents copper ions from passing or a monovalent membrane that offers more resistance to Cu++ ions. In the single membrane design, the thief electrode is separated from the catholyte 202 by a single membrane, such as a flat or planar anionic membrane, and the thief electrode assembly has a single compartment. As used here, separated from means that the electrolytes on either side of a membrane are both touching the membrane, to allow the membrane to pass selected species as intended.

In FIGS. 3 and 4, with the thief electrode assembly located below the center of vessel assembly, the designs described above are achieved with smaller membranes that are easier to seal.

Conceptually, a centrally located thief acts circumferentially, beyond the edge of the wafer though a virtual anode channel. Since the thief current is relatively small compared to the anode currents, it is adequate to have a small, centrally located thief electrode (and its associated structure) rather than a thief electrode or assembly equal to or greater the circumference of the wafer as in currently used processor designs.

In a processor 20 without a paddle agitator, the virtual thief position or opening 99 may be below the wafer plane as shown in FIG. 3-4. In a processor with a paddle agitator, the virtual thief position 99 may be at or above the wafer plane. The virtual thief position or opening 99 may be provided as a continuous annular opening, a segmented opening, or as one or more arcs. For example, a virtual thief position or opening 99 may subtend an arc of 30 degrees, so that the current thief acts over only a relatively small sector of the wafer. This design may be useful of non-symmetry edge control in a location like a notch, or for processors not having sufficient room for a circumferential current thief opening. In these designs, if the wafer rotates during processing, the current thieving at the edge of the wafer averages out over the entire circumference of the wafer.

Referring back to FIGS. 11-12, when coupled to a three chamber replenishment cell, the three electrolytes within the compartment assembly can be matched to the three chambers in the replenishment cell. Catholyte 202 flows to replenishment anolyte (with consumable anodes). Thief assembly isolyte flows to replenishment cell mid-chamber isolyte (as does the chamber anolyte). Thief assembly thiefolyte flows to replenishment cell catholyte. The thief electrode can be run in reverse current for periodic maintenance.

In an alternative design, the electroplating processor has a vessel assembly holding a catholyte containing metal ions, and a head having a wafer holder 36, with the head movable to position the wafer holder 36 in the vessel assembly, and one or more anodes in the vessel assembly. A first electrolyte or thiefolyte compartment contains a first electrolyte or thiefolyte, with the thiefolyte separated from a second electrolyte or isolyte by a first membrane. An electric current thief electrode is located in the thiefolyte compartment and is connected to an auxiliary cathode. At least one virtual thief current channel is filled with catholyte and extends from the first membrane to a virtual thief opening around a wafer in the wafer holder 36, with the virtual thief opening having a diameter larger than the wafer, and with the thiefolyte compartment having a largest characteristic dimension that is smaller than the diameter of the wafer. The thiefolyte compartment may be rectangular wherein the largest characteristic dimension is the length of the thiefolyte compartment. The anode may be an inert anode or a consumable anode. The inert anode, if used, may be a wire in a membrane tube.

The invention claimed is:

1. An electroplating processor, comprising:

a vessel holding a catholyte containing metal ions;

a head having a wafer holder, with the head movable to position the wafer holder in the vessel;

at least one anode in the vessel;

an isolyte compartment containing an isolyte, with the isolyte separated from the catholyte by a first membrane;

a thiefolyte compartment containing a thiefolyte, with the thiefolyte separated from the isolyte by a second membrane; and a current thief electrode in the thiefolyte compartment.

2. The processor of claim 1 further including at least one thief current channel filled with the catholyte and extending from the first membrane to a virtual thief position above the at least one anode.

3. The processor of claim 2 with the virtual thief position extending around a perimeter of the wafer.

4. The processor of claim 2 with the virtual thief position vertically above a wafer held in the wafer holder.

5. The processor of claim 4 having a plurality of thief current channels filled with catholyte, and with each thief current channel having a horizontal section and a vertical section.

6. The processor of claim 1 wherein the first membrane and/or the second membrane comprises a cation membrane or a monovalent membrane.

7. The processor of claim 1 with the anode comprising a wire within a membrane tube containing an anolyte, wherein the anolyte and the isolyte are the same electrolyte.

8. The processor of claim 1 comprising an inner anode surrounded by an outer anode, and with each anode comprising a wire within a membrane tube containing an anolyte.

9. The processor of claim 1 further including a replenisher cell connected to the vessel for replacing metal ions in the catholyte, and with the replenisher cell also connected to the anolyte compartment and to the isolyte compartment.

10. The processor of claim 1 with the second membrane comprising a membrane tube.

11. The processor of claim 1 further including an inner ring between the at least one anode and the wafer holder, with the inner ring having an upper surface curving downward to a central opening of the inner ring, and with the inner ring having a plurality of vertical through openings.

12. The processor of claim 1 having no electric field shield in the vessel.

13. The processor of claim 1 wherein the isolyte compartment is on an outside bottom surface of the vessel.

14. The processor of claim 1 wherein the thiefolyte compartment is rectangular and has a largest characteristic dimension equal to a length of the thiefolyte compartment.

15. The processor of claim 1 with the anode comprising an inert anode or a consumable anode.

16. The processor of claim 15 wherein the inert anode comprises a wire in a membrane tube.

17. The electroplating processor of claim 1 further including a virtual thief opening around a wafer in the wafer holder with the virtual thief opening having a diameter larger than the wafer, and with the thiefolyte compartment having a largest characteristic dimension that is smaller than the diameter of the wafer.

* * * * *